United States Patent [19]

Miller

[11] 4,073,435

[45] Feb. 14, 1978

[54] RAILWAY RAIL-FASTENING CLIP AND A RAILWAY RAIL-AND-FASTENING ASSEMBLY EMPLOYING IT

[75] Inventor: David William Miller, Retford, England

[73] Assignee: Pandrol Limited, London, England

[21] Appl. No.: 738,963

[22] Filed: Nov. 4, 1976

[30] Foreign Application Priority Data

Nov. 7, 1975 United Kingdom ..... 46281/75

[51] Int. Cl.[2] ..... E01B 9/30

[52] U.S. Cl. ..... 238/349

[58] Field of Search ..... 238/349, 338, 310, 315

[56] References Cited

U.S. PATENT DOCUMENTS 3,297,253 1/1967 Astley et al. ..... 238/349

3,658,246 4/1972 Davies ..... 238/349

FOREIGN PATENT DOCUMENTS 2,461,158 7/1975 Germany ..... 238/349

*Primary Examiner*—Drayton E. Hoffman
*Assistant Examiner*—Randolph A. Reese
*Attorney, Agent, or Firm*—Haseltine, Lake & Waters

[57] ABSTRACT

A rail clip is made by bending a metal rod with a length less than 18 times its thickness so that it has a substantially straight leg which lies substantially parallel to a railway rail in use of the clip and portions on both sides of this leg which press on the rail and a fixed surface, respectively. An arch connecting one of these portions to the leg rises at an angle of less than 45° to the horizontal, proceeding along the rod away from the leg.

12 Claims, 9 Drawing Figures

Figure 1:
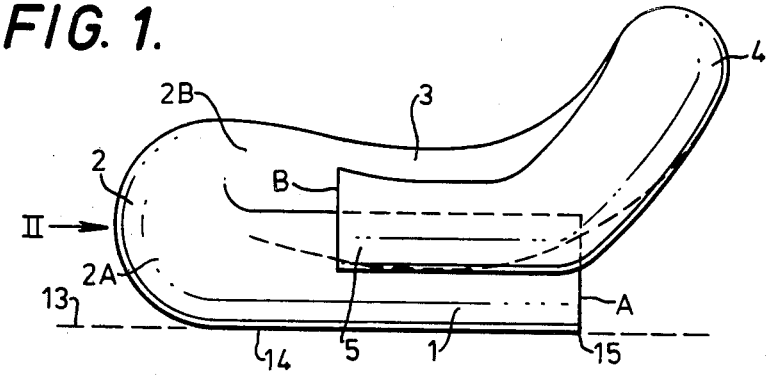

RAILWAY RAIL-FASTENING CLIP AND A RAILWAY RAIL-AND-FASTENING ASSEMBLY EMPLOYING IT

According to a first aspect of the present invention, a railway rail-fastening clip comprises a rod of resilient metal with a length less than 18 times its thickness which has been bent so as to have, progressing from one end of the rod to the other end, a first portion which starts at said one end of the rod and is a straight or nearly straight leg, then a second portion, then a third portion, then a fourth portion and finally a fifth portion which ends at said other end of the rod, these portions being such that, when the clip is in a particular position, the lowermost points on the opposite ends of the first portion are in the same horizontal plane as one another and the lowermost points on the third and fifth portions are in the same horizontal plane as one another, and the second portion, proceeding from the first portion to the third portion, has a rising part followed by a falling part and when the clip is viewed from above the third and fifth portions appear to be on opposite sides of the axis of the first portion and when the clip is viewed in a horizontal direction parallel to a straight line passing through the lowermost points on the opposite ends of the first portion, said rising part of the second portion is seen to be inclined to the horizontal by, everywhere, less than 45°.

The second plane mentioned above may be lower than or coincident with, but is preferably higher than, the first.

Preferably, the rod has a length less than 17 times its thickness, better still less than 16 times its thickness and even better less than 15 times its thickness.

The rising part of the second portion, when viewed as indicated above, may be seen to be inclined to the horizontal by, everywhere, less than 40° and/or seen to be inclined to the horizontal by about 35° over most of its length.

Preferably, when the clip is in said position, the highest point on the upper side of the second portion is lower than the highest point on the upper side of the fourth portion.

The clip is preferably made from a rod of circular cross-section at least 1 cm. in diameter.

There may with advantage be a flat surface on the side of the fifth portion which is the lower side when the clip is in said position, this flat surface having a length greater than 1½ times, preferably greater than twice, the thickness of the rod.

The fifth portion may have been given its final shape by having been supported by a lower support member which has contacted it over a length of more than 1 centimeter when the fifth portion has been pressed downwardly while red hot.

The above particulars refer to the clip when it is not in use, i.e. is unstressed.

According to a second aspect of the invention, a railway rail-and-fastening assembly comprises a rail foundation, a rail laid on the rail foundation between two projections extending upwardly from the rail foundation and two clips according to the first aspect of the invention, each clip having its first portion substantially parallel to the rail and held down by one of said projections, its third or fifth portion bearing downwardly on the rail flange, directly or through an electrical insulator on the rail flange, and its fifth or third portion bearing downwardly on an unyielding surface which, as seen from the rail, is beyond said first portion.

Figure 2:
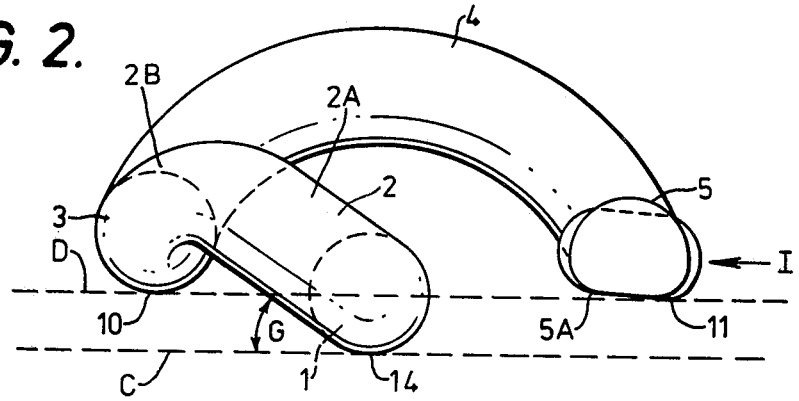
Figure 3:
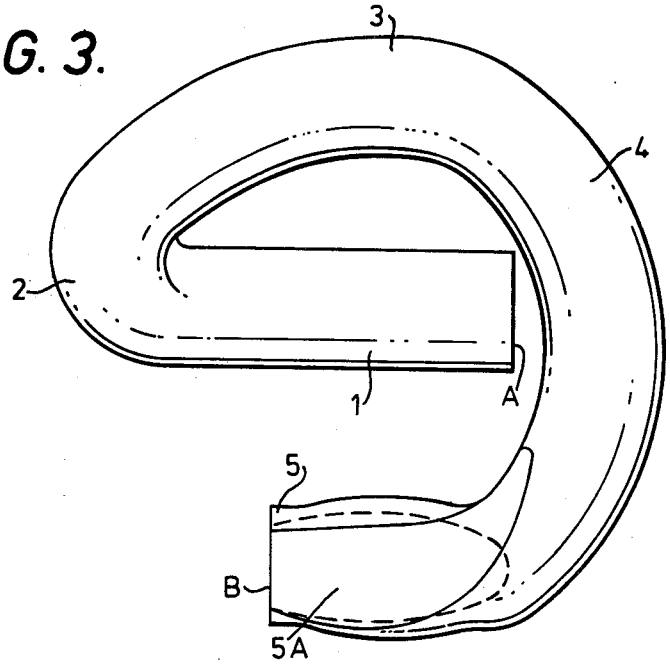
Figure 4:
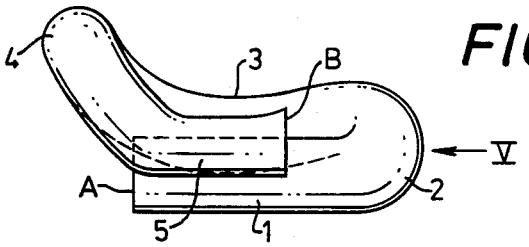
Figure 5:
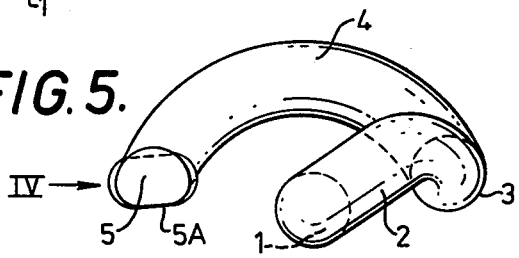
Figure 6:
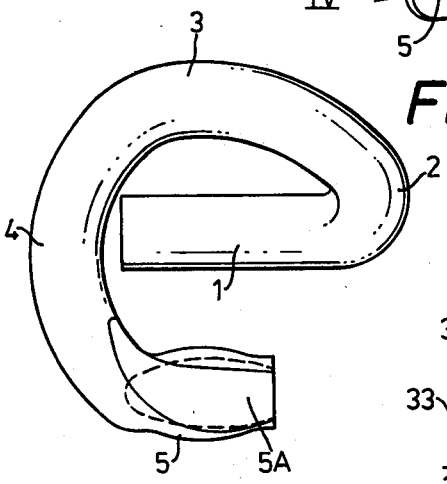
Figure 7:
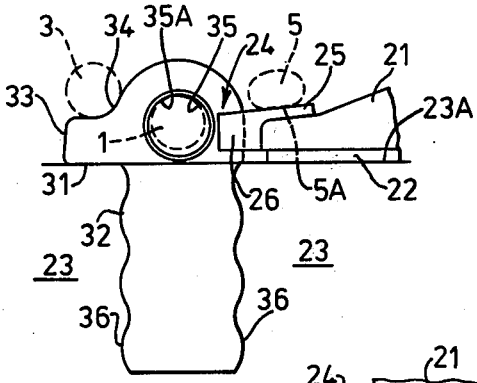
Figure 8:
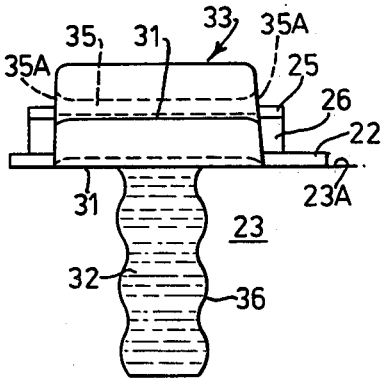
Figure 9:
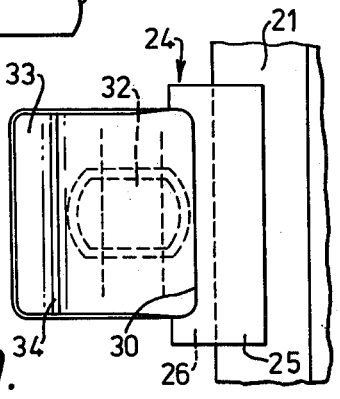

Examples in accordance with the invention are described below with reference to the accompanying drawings, in which:

FIG. 1 shows a side view of a railway rail-fastening clip, taken in the direction of the arrow I in FIG. 2, FIG. 2 shows an end view of the same clip, taken in the direction of the arrow II in FIG. 1, FIG. 3 shows a plan view of the same clip, FIGS. 4 to 6 show views, corresponding to those of FIGS. 1 to 3, respectively, of another railway rail-fastening clip, FIG. 7 shows an end view of a railway rail-and-fastening assembly including the clip of FIGS. 1 to 3, which is shown only by means of dotted lines, FIG. 8 shows a side view of the same assembly but without the clip, and FIG. 9 shows a plan view of the same assembly but without the clip.

The clip shown in FIGS. 1 to 3 is made by bending a rod of resilient steel 28.8 centimeters long, of circular cross-section and 2.00 centimeters diameter so that it has, proceeding from the end A to the end B, a first portion 1 which starts at the end A, a second portion 2, a third portion 3, a fourth portion 4 and a fifth portion 5 which ends at the end B.

In the illustrated position of the clip, a horizontal plane D (FIG. 2) contains the lowermost points 10 and 11 on the third and fifth portions 3 and 5 and a lower horizontal plane C contains the lowermost points 14 and 15 on the opposite ends of the first portion 1 (and the lowermost points all along the first portion 1 in this case because the first portion 1 is straight; it could instead be slightly bowed, for example arched).

When the clip is viewed in a horizontal direction (see arrow II) parallel to a straight line 13 passing through the points 14 and 15, it is seen that the second portion 2 has, proceeding from the portion 1 to the portion 3, a rising part 2A followed by a falling part 2B, the angle G between the rising part 2A and the horizontal plane C being everywhere less than 40° and about 35° over most of the length of the part 2A. No part of the clip is vertically above any part of the portion 1. The highest point on the upper side of the portion 2 is lower than the highest point on the upper side of the portion 4. When the clip is viewed from above the third and fifth portions 3 and 5 appear to be on opposite sides of the axis of the first portion 1 and the clip looks rather like a mirror-image of a letter *e*. The illustrated clip is intended to bear upon the flange at one side of a flat-bottomed or flange-footed railway rail. The shape of a corresponding clip to be driven in the same direction and to bear upon the flange at the opposite side of the rail (if such a clip is needed) is shown in FIGS. 4 to 6. In plan view this clip looks rather like a letter *e*. Apart from this, the above description of the clip of FIGS. 1 to 3 and details of angles, dimensions, etc., apply to the clip of FIGS. 4 to 6.

There is a flat surface 5A, 4.4 centimeters long, on the lower side of the fifth portion 5. The fifth portion 5 has been given its final shape by having been supported by a lower support member which has contacted it over a continuous length, including the whole of the flat surface 5A, when the fifth portion 5 has been pressed downwardly, while red hot, by an upper shaping tool.

In FIGS. 7 to 9, there is shown the flange 21 of a flange-footed railway rail resting on a rubber pad 22 which is laid on the upper surface 23A of a concrete railway sleeper 23. On the two sides of the rail there are two similar arrangements for holding the rail down, although this is shown only in the case of the left-hand side. It includes a clip as described above and illustrated in FIGS. 1 to 3, only the parts 1, 3, 5 and 5A of the clip being shown, in FIG. 7. On the right-hand side of the rail there is again a clip according to FIGS. 1 to 3 but it is driven in the opposite direction. On the edge of the flange there is placed an elongate electrical insulator 24, consisting of moulded nylon, of approximately L-shaped cross-section, one limb 25 of which lies on the rail flange and has the flat surface 5A of the portion 5 pressing downwardly upon it, this flat surface being parallel to the upper face of that part of the rail flange which is beneath it. The other limb 26 of the insulator 24 lies against the side of the rail flange and has a recess 30 in it.

An anchoring member is fixed to the sleeper, this consisting of cast malleable iron and comprising a flat surface 31 lying on the upper surface 23A of the sleeper, a projecting leg 32 extending downwardly into the sleeper, a block portion 33, substantially square as seen in plan, extending upwardly from the surface 31, a concave surface 34 at the top of the block portion 33 and a passage 35 of circular cross-section, having flared mouths 35A, in the block portion 33. The portion 1 of the rail clip is driven in the passage 35 and is held down by the roof of the passage in a position substantially parallel to the rail, whereas the part 3 of the rail clip presses downwardly on the concave surface 34. Part of the block portion 33 lies in the recess 30 in the insulator 24 so that the insulator is prevented from sliding along the rail when the clip is being driven into position, by abutting the block portion 33.

The leg 32 of the anchoring member is formed with protuberances 36 on all four sides and it is cast in the concrete, that is to say incorporated in the concrete before the latter has set.

The insulator 24 could be omitted, the portion 5 of the clip then bearing directly on the rail flange.

The clip could instead be driven so that the portion 3 bears on the rail flange, directly or through the insulator 24, and the portion 5 bears on the surface 34.

I claim:

1. A railway rail-fastening clip comprising a rod of resilient metal with a length less than 18 times its thickness which has been bent so as to have, progressing from one end of the rod to the other end, a first portion which starts at said one end of the rod and is a substantially straight leg, then a second portion, then a third portion, then a fourth portion and finally a fifth portion which ends at said other end of the rod, these portions being such that, when the clip is in a particular position, the lowermost points on the opposite ends of the first portion are in the same horizontal plane as one another and the lowermost points on the third and fifth portions are in the same horizontal plane as one another, and the second portion, proceeding from the first portion to the third portion, has a rising part followed by a falling part and when the clip is viewed from above the third and fifth portions appear to be on opposite sides of the axis of the first portion and when the clip is viewed in a horizontal direction parallel to a straight line passing through the lowermost points on the opposite ends of the first portion, said rising part of the second portion is seen to be inclined to the horizontal by, everywhere, less than 45°.

2. A clip according to claim 1 which is such that, when it is in said position, the second plane mentioned in claim 1 is higher than the first plane.

3. A clip according to claim 1 in which the rod has a length less than 17 times its thickness.

4. A clip according to claim 1 in which the rod has a length less than 16 times its thickness.

5. A clip according to claim 1 in which the rod has a length less than 15 times its thickness.

6. A clip according to claim 1 in which the rising part of the second portion, when viewed as indicated in claim 1, is seen to be inclined to the horizontal by, everywhere, less than 40°.

7. A clip according to claim 1 in which the rising part of the second portion, when viewed as indicated in claim 1, is seen to be inclined to the horizontal by about 35° over most of its length.

8. A clip according to claim 1 which is such that, when it is in said position, the highest point on the upper side of the second portion is lower than the highest point on the upper side of the fourth portion.

9. A clip according to claim 1 and such that, when it is in said position, no part of the clip is vertically above any part of said first portion.

10. A clip according to claim 1 in which there is a flat surface, the length of which is greater than 1½ times the thickness of the rod, on the side of the fifth portion which is the lower side when the clip is in said position.

11. A railway rail-and-fastening assembly comprising a rail foundation, a rail laid on the rail foundation between two projections extending upwardly from the rail foundation and two clips each comprising a rod of resilient metal with a length less than 18 times its thickness which has been bent so as to have, progressing from one end of the rod to the other end, a first portion which starts at said one end of the rod and is a substantially straight leg, than a second portion, then a third portion, then a fourth portion and finally a fifth portion which ends at said other end of the rod, these portions being such that, when the clip is in a particular position, the lowermost points on the opposite ends of the first portion are in the same horizontal plane as one another and the lowermost points on the third and fifth portions are in the same horizontal plane as one another, and the second portion, proceeding from the first portion to the third portion, has a rising part followed by a falling part and when the clip is viewed from above the third and fifth portions appear to be on opposite sides of the axis of the first portion and when the clip is viewed in a horizontal direction parallel to a straight line passing through the lowermost points on the opposite ends of the first portion, said rising part of the second portion is seen to be inclined to the horizontal by, everywhere, less than 45°, each clip having its first portion substantially parallel to the rail and held down by one of said projections, one of its third and fifth portions bearing downwardly on the rail flange and the other of its third and fifth portions bearing downwardly on an unyielding surface which, as seen from the rail, is beyond said first portion.

12. A railway rail-and-fastening assembly comprising a rail foundation, a rail laid on the rail foundation between two projections extending upwardly from the rail foundation and two clips each comprising a rod of resilient metal with a length less than 18 times its thickness which has been bent so as to have, progressing from one end of the rod to the other end, a first portion which starts at said one end of the rod and is a substantially straight leg, then a second portion, then a third portion, then a fourth portion and finally a fifth portion which ends at said other end of the rod, these portions being such that, when the clip is in a particular position, the lowermost points on the opposite ends of the first portion are in the same horizontal plane as one another and the lowermost points on the third and fifth portions are in the same horizontal plane as one another, and the second portion, proceeding from the first portion to the third portion, has a rising part followed by a falling part and when the clip is viewed from above the third and fifth portions appear to be on opposite sides of the axis of the first portion and when the clip is viewed in a horizontal direction parallel to a straight line passing through the lowermost points on the opposite ends of the first portion, said rising part of the second portion is seen to be inclined to the horizontal by, everywhere, less than 45°, each clip having its first portion substantially parallel to the rail and held down by one of said projections, its fifth portion bearing downwardly on the rail flange and its third portion bearing downwardly on an unyielding surface which, as seen from the rail, is beyond said first portion.

* * * * *